US006510862B2

(12) United States Patent
Prentice

(10) Patent No.: US 6,510,862 B2
(45) Date of Patent: Jan. 28, 2003

(54) MARINE ENGINE WINTERIZING SYSTEM

(76) Inventor: Carl Prentice, Lot 26, Concession 2, Esquesing Township, Acton, Ontario (CA)

( * ) Notice: Subject to any disclaimer, the term of this patent is extended or adjusted under 35 U.S.C. 154(b) by 0 days.

(21) Appl. No.: 09/949,426

(22) Filed: Sep. 7, 2001

(65) Prior Publication Data

US 2002/0069912 A1 Jun. 13, 2002

Related U.S. Application Data

(63) Continuation-in-part of application No. 09/578,200, filed on May 24, 2000, now abandoned, which is a continuation-in-part of application No. 09/301,165, filed on Apr. 28, 1999, now abandoned.

(51) Int. Cl.[7] ..... F04F 1/06
(52) U.S. Cl. ..... 137/205; 137/209
(58) Field of Search ..... 137/205, 209

(56) References Cited

U.S. PATENT DOCUMENTS

| | | | | | |
|---|---|---|---|---|---|
| 1,587,864 | A | | 6/1926 | Sargent | 137/205 |
| 2,740,420 | A | | 4/1956 | Hanks | 137/205 |
| 3,971,400 | A | | 7/1976 | Thompson | 137/205 |
| 4,057,364 | A | | 11/1977 | Bratschitsch | 137/205 X |
| 4,082,124 | A | | 4/1978 | Jenkins | 137/205 X |
| 5,337,774 | A | * | 8/1994 | Boyd | 137/1 |
| 5,427,505 | A | * | 6/1995 | Payne | 137/205 |
| 5,476,154 | A | | 12/1995 | Sage | 222/399 X |
| 5,492,144 | A | * | 2/1996 | Kriewaldt | 137/205 |
| 5,681,456 | A | * | 10/1997 | Delport | 123/41.14 |
| 5,772,402 | A | | 6/1998 | Goodman | 137/205 X |

* cited by examiner

*Primary Examiner*—Gerald A. Michalsky
(74) *Attorney, Agent, or Firm*—Pearne & Gordon LLP

(57) ABSTRACT

This is a system and procedure that uses either a hand pump system or an electric pump system to drain fresh water or sea water out of a marine engine, and then uses either the hand pump system or the electric pump system to install fresh water or other liquid chemicals into the marine engine, and also uses either the hand pump system or the electric pump system to recover the liquid chemicals from the marine engine.

3 Claims, 2 Drawing Sheets

MARINE ENGINE WINTERIZING SYSTEM

This application is a continuation-in-part of U.S. patent application Ser. No. 09/578,200, filed May 24, 2000 now abandoned, which was, a continuation-in-part of U.S. patent application Ser. No. 09/301,165, filed Apr. 28, 1999, now abandoned.

FIELD OF THE INVENTION

The invention relates to the field of marine engine winterizing systems, and more particularly, to marine engine winterizing systems that can flush fresh water or sea water from the marine engine quickly and easily, stabilize the engine with liquid chemicals during the wintertime, and reclaim the liquid chemicals in the spring.

BACKGROUND OF THE INVENTION

Several attempts have been made in the prior art to provide a system that winterizes and dewinterizes an engine by pumping and storing engine coolant.

For example, U.S. Pat. No. 5,337,774 to Boyd discloses a system for winterizing a marine engine that includes a pump with a closed coolant storage tank working in association with a second pump and an open coolant recovery tank. The coolant fluid transfer lines connect the storage tank pump outlet to the recovery tank and connect the recovery tank pump outlet to the storage tank, further incorporating a control for operating the storage tank pump and recovery tank pump independently of each other. Antifreeze is discharged into, and removed from, the system by running the engine and pump at the same time. In winterization, antifreeze is pumped from the recovery tank into the engine and water is pushed out of the engine. In dewinterization, when water is pumped into the engine, antifreeze is pushed out and can be recollected in the recovery tank where it can be pumped to a supply tank for proper disposal or reuse.

U.S. Pat. No. 5,681,456 to Delport discloses a pressure-vacuum method for removing and replacing engine coolant in automobiles. The coolant is suctioned through a vacuum line into a holding tank and a pressure pump is used to deliver a new coolant. A quick connect coupler can be used for quick connection and disconnection to the engine.

In U.S. Pat. No. 3,971,400 to Thompson and U.S. Pat. No. 4,057,364 to Bratschitsch, each discloses a pumping system for drawing liquid into or discharging the liquid from a tank by creating respectively a vacuum or pressurized conditions within the tank. It provides a special valve device to preclude the entry of contaminants into the pump.

In U.S. Pat. No. 1,587,864 to Sargent and U.S. Pat. No. 4,082,124 to Jenkins, each discloses an apparatus with two divided chambers of a tank and an air compressor driven from an engine or a pump. One chamber is used for holding the waste liquid by pressure transferred on application of air pressure or vacuum in the other chamber, where the other chamber keeps clean water or air.

U.S. Pat. No. 5,427,505 to Payne discloses a system including a storage tank, air pressure system for selectively applying the fluid pressure to the tank for extracting and injecting liquid coolant from and into a reservoir for an engine cooling system, and a hose connects the tank to the engine cooling system reservoir through a double shut-off-type coupling.

U.S. Pat. No. 5,476,154 to Sage discloses an oil changing apparatus having a single air compressor with internal combustion engine to provide vacuum to suction the oil from the motorized oil engine to the storage tank, and to pressurize the air to drain the storage tank rapidly. Fresh oil is added to the engine manually by gravity. Standard quick coupling connectors are employed to prevent leakage.

U.S. Pat. No. 5,492,144 to Kriewaldt discloses vacuum tanks connected to a vacuum pump, which removes various operating liquids from fill ports of a salvage vehicle. Portions of the fumes drawn off through the vacuum line from the fluids in the tanks are fed through vacuum pump and burnt by the engine to drive the vacuum pump.

Many of the prior art only use a one-tank system to draw and discharge liquid. Separate processes are required to fill the engine with fresh liquid. Some of the prior art use two compartments in a tank system to separate the fresh liquid from the old liquid, however, many valves are involved, causing difficulties in operation.

SUMMARY OF THE INVENTION

It is an object of the present invention to provide a marine engine winterizing system that is an improvement over the prior art.

It is a further object of the invention to provide a marine engine winterizing system that can reclaim the liquid chemicals in the spring time easily and efficiently without damaging the marine engine or its environment.

The present invention has many advantages. It reduces the time necessary to remove water from a marine engine which includes manifolds and coolers. It installs liquid chemicals into a marine engine faster than the previous systems. It removes liquid chemicals from the marine engine without polluting the water or the liquid chemicals, thereby allowing the liquid chemical to be reused.

Other advantages, objects and features of the present invention will be readily apparent to those skilled in the art from a review of the following detailed descriptions of the preferred embodiments in conjunction with the accompanying drawings and claims.

According to one aspect of the present invention, there is provided a two-part device for transferring liquid to or from an engine, the first part of said device comprising at least one engine connection means attachable to the engine water exhaust manifolds; one line for each of said engine connection means, said line being anchored at one end to said engine connection means, and anchored at the other end to a vacuum pressure manifold, said vacuum pressure manifold housing a pump connection means for each line; and the second part of said device comprising a pump; two tanks connected to said pump, a first tank for holding the liquid drawn from the engine, and a second tank for holding the liquid to be transferred to the engine; two lines connected to said tanks, wherein a first vacuum line is connected to said pump for drawing liquid from the engine to the tank, and a first pressure line is connected to said pump for pushing liquid from the tank into the engine; connection means complementary to said pump connection means; and actuation means connected to a second vacuum line and a second pressure line, said actuation means controlling the function of said second vacuum line and said second pressure line, wherein when the second vacuum line is activated, fluid is drawn from the engine into the tank, and when the second pressure line is activated, fluid is pushed from the tank into the engine.

According to another aspect of the present invention, there is provided a device for transferring liquid to or from an engine, said device being comprised of a hand pump, and complementary connection means associated with the pump and engine, said connection means facilitating attachment of the hand pump to the engine. Two lines connect to the hand pump, the first line vacuum-drawing liquid from the engine, and the second line pressure-pushing liquid to a container. Actuation means on said system is by manually working the hand pump, said activation means controlling the drawing of liquid from the engine and the pushing of liquid into in the engine. By turning the body of the hand pump, the flow of liquid is reversed.

DETAILED DESCRIPTION OF THE DRAWINGS

Figure 1:
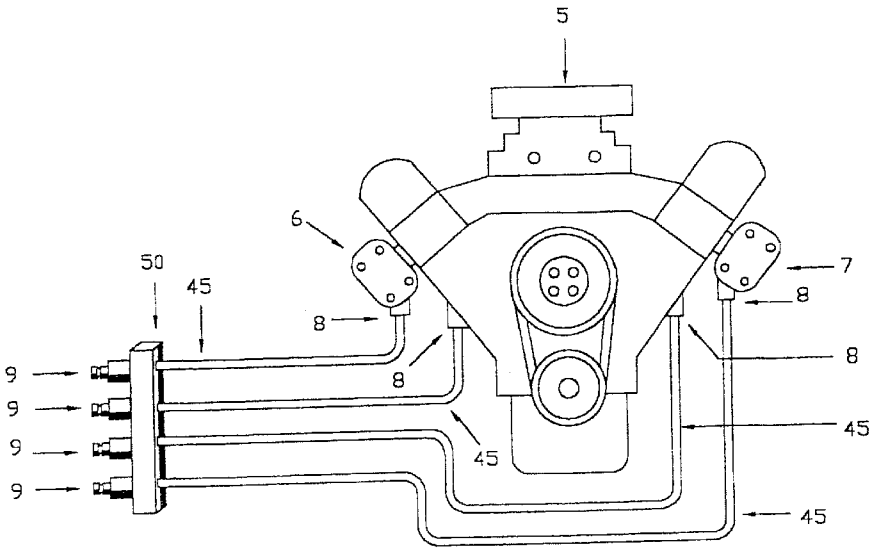
FIG. 1 illustrates a schematic representation of one embodiment of the present invention, an engine winterization system.
Figure 1:
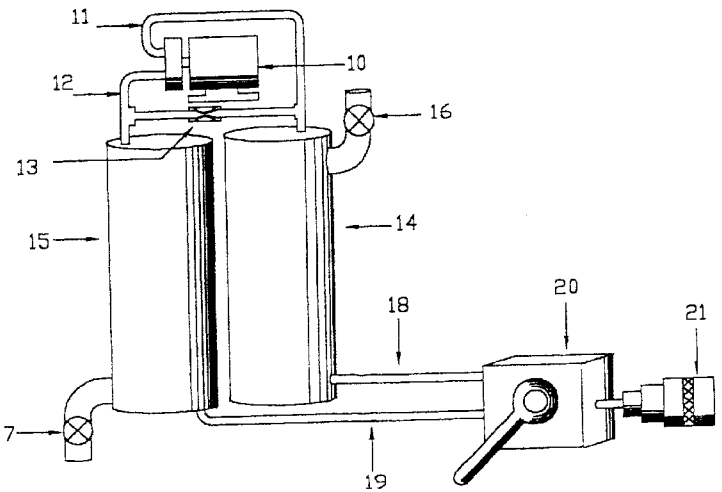

Referring to FIG. 1, the marine engine winterizing system 1, is comprised of an electric motor vacuum pressure pump 10, which typically includes vacuum line 12 and pressure line 11, both of which have connections to a small bleeder line 13. Pressure line 11 connects to pressure tank 14, while vacuum line 12 connects to vacuum tank 15. The pressure tank 14 has a removable top 16 for fast filling of liquids. The vacuum tank 15 has a removable bottom 7 to remove liquids quickly and easily. Line 18 is the pressure line to control valve 20, and line 19 is the vacuum line to control valve 20. Control valve 20 will control the liquid flow at the female quick connect fitting 21. Turning the control valve to remove position will put vacuum at the female quick connect fitting 21 drawing liquids from the engine and moving the control valve 20 to fill position will put pressure to the female quick connect fitting 21, pushing liquids into the engine. The bleeder line 13 will limit the pressure and vacuum in the tanks and lines and release pressure and vacuum when the electric motor is shut off.

In a preferred embodiment, the vacuum pump is the ½ HP electrically driven vane pump with high volume of air and vacuum, which provides a pressure of not more than 30 psi. Pressure line and vacuum line are made of metal, The tanks are made of glass, clear styrene acryl nitrile or polycarbonate plastic.

The marine engine 5 is refitted with special fittings 8 (to replace the current water draining fittings), and a plastic or nylon tube 45, is attached to the male disconnect fittings 9, which are mounted on a vacuum pressure manifold 50. The vacuum pressure manifold 50 is permanently mounted within easy access of the engine, whether on the engine itself or on the boat. There is at least one male disconnect fitting 9, for each water drain fitting on the engine 5, water exhaust manifolds 6 & 7, and coolers (some engines have up to 7 fittings).

In operation, a person who wants to winterize or flush a marine engine, installs the fittings 8 onto engine 5, water exhaust manifold drain cocks, and all other drain cocks, and install lines 45, vacuum pressure manifold 50, and the male disconnect fittings 9. If there are five drain cocks, there should be five lines 45, and five male disconnect fittings 9, on the vacuum pressure manifold 50. This is a one time installation and only needs inspection periodically.

To remove liquids from the marine engine 5, the operator turns the handle on the control valve 20 to remove position, turns on the electric vacuum-pressure pump, then installs the female quick disconnect fitting 21, onto any male disconnect fitting 9. An indication that all the water has been drawn from that water chamber is indicated by the formation of air bubbles in the tank 15. While the electric vacuum-pressure pump is still running, the operator removes the female quick disconnect fitting 21, and installs it onto another male quick disconnect fitting 9, this process is continued until all the male quick disconnect fittings 9 have been emptied. The female quick disconnect fitting 21 has an internal shut-off valve that is pushed by the male disconnect fitting, which stops the fluid when the control valve is switched to fill position.

To install liquids into the marine engine 5, the operator turns the handle on the control valve 20 to install position, turns on the electric vacuum-pressure pump, then installs the female quick disconnect fitting 21, onto any male disconnect fitting 9. A graduated scale on tank 14 will indicated how much liquid has been installed into that engine connection. While the electric vacuum-pressure pump is still running, the operator removes the female quick disconnect fitting 21, and installs it onto another male quick disconnect fitting 9, this process is continued until all the male quick disconnect fittings 9 have been filled.

Figure 2:
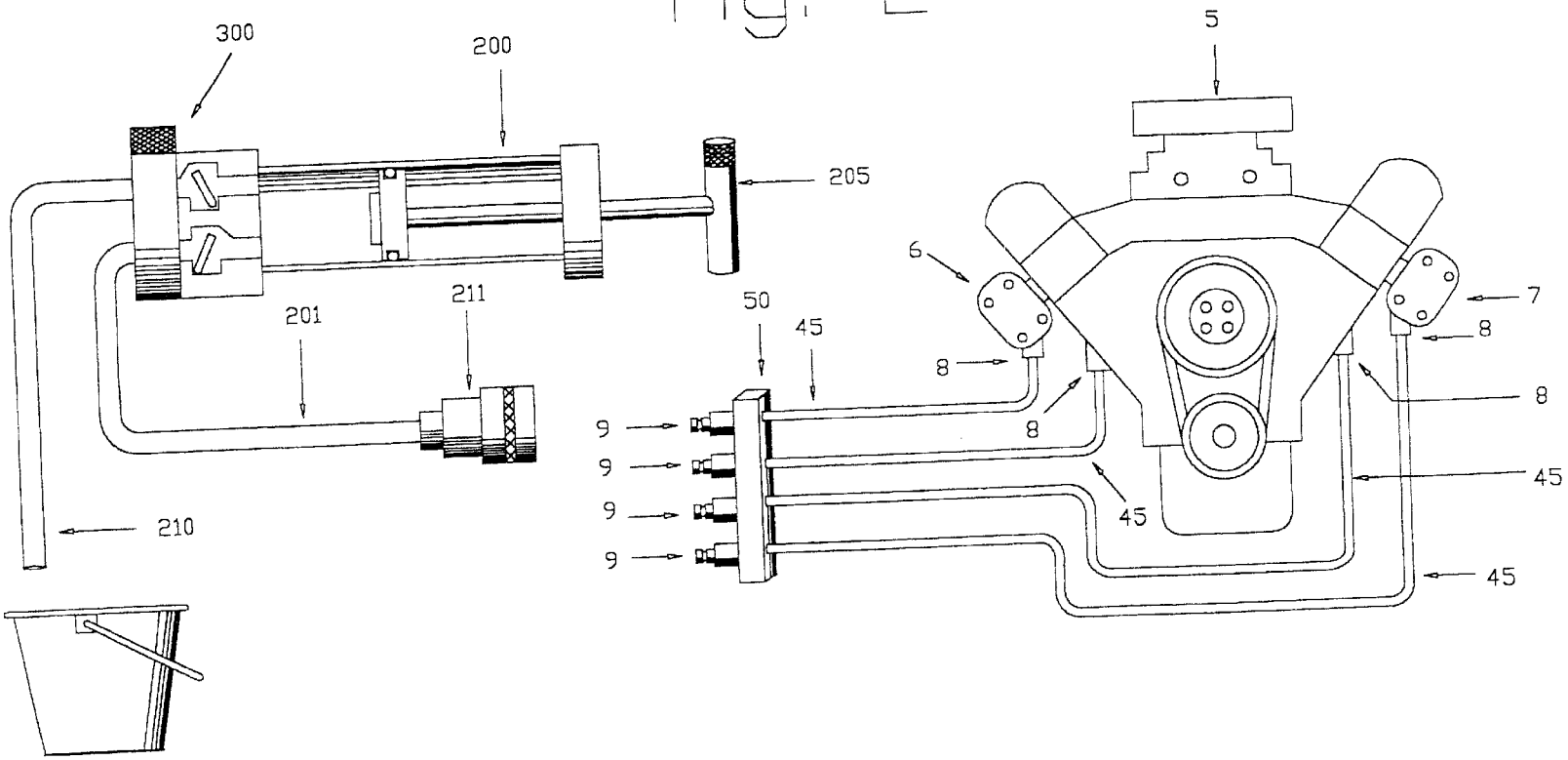
FIG. 2 illustrates a schematic representation of a second embodiment of the present invention.

Referring to FIG. 2, the marine engine winterizing system is comprised of a hand-operated vacuum-pressure pump 200, and vacuum pressure manifold system.

The marine engine 5 is refitted with special fittings 8 (to replace the current water-draining fittings) and adapted to a plastic or nylon tube 45, which will be attached to the male disconnect fittings 9 which are mounted on a vacuum pressure manifold 50. The vacuum pressure manifold 50 is mounted within easy access of the engine, whether on the engine itself or on the boat. There is at least one male disconnect fitting 9 for each water drain fitting on the engine 5, water exhaust manifolds 6,7 and water oil coolers.

In operation, a person who wants to winterize of flush a marine engine would install the fittings 8 onto the engine 5, water exhaust manifold drain cocks, and all other drain cocks, and install lines 45, vacuum pressure manifold 50, and the male disconnect fittings 9. If there are five drain cocks, there should be five lines 45, and five male disconnect fittings 9 on the vacuum pressure manifold 50. This is a one-time installation and only needs inspection periodically.

To remove liquids from the marine engine 5, the operator turns the handle 205 on the hand pump 200 to align with an indicator 300. The operator then installs the female quick disconnect fitting 211 onto the male quick disconnect fitting 9 mounted on the vacuum pressure manifold 50. By moving the hand pump handle 205 in and out, the pump action will remove any liquid in the engine water jacket. The pressure line 210 can be put into any container to catch the liquid that is being removed. The operator then moves the female quick disconnect fitting 211 to the next male quick disconnect fitting 9 and repeats the process. When all male quick disconnect fittings have been emptied, all liquids from the engine water jackets will have been removed. The operator will know when the water jacket is empty when he feels less pressure on the pump handle 205 when pumping air and not liquid.

To install liquids into the marine engine 5, the operator would turn the handle 205 on the hand pump 200, 180 degrees with the indicator 300. The operator then installs the female quick disconnect fitting 211 onto the male quick disconnect fitting 9 mounted on the vacuum pressure manifold 50. The pressure line 210 will now become a vacuum line and must be put into the container that contains the liquid that the operator wants installed into the engine water jackets. By moving the hand pump handle 205 in and out, the pump action will install any liquid in the engine water jacket. The operator then moves the female quick disconnect fitting 211 to the next male quick disconnect fitting 9 and repeats the process. When all male quick disconnect fitting have been filled, the engine water jackets are protected. Counting the number of strokes it takes to empty each male disconnect fitting 9 will give an indication of how many strokes it will take to fill each male disconnect fitting 9.

Removing Liquids from the Engine

Power System

To remove liquids from the engine 5, the operator turns the handle on the control valve 20 to remove position, turns on the electric motor, installs the female quick connect fitting 21 to the male quick connect fitting 9, and waits until bubbles appear in the tank 15. The operator then moves the female quick connect fitting 21 to another male quick fitting 9 and repeats procedure until all the male quick connect fittings 9 are empty.

Manual System

To remove liquids from the engine 5, the operator installs the female quick connect fitting 21 to the male quick connect fitting 9, puts the hand pump onto remove, and manually pumps until no resistance is felt on the pump handle. The operator then moves the female quick connect fitting 21 to another male quick connect fitting 9 and repeats the procedure until all the male quick connect fittings 9 are empty.

Installing Liquids into the Engine

Power System

To install liquids into the engine 5, the operator turns the handle on the control valve 20 to install position turns on the electric motor, installs the female quick connect fitting 21 to the male quick connect fitting 9, and monitors the amount of liquid installed by watching the liquid level in the graduated tank 14. The operator then moves the female quick connect fitting 21 to another male quick fitting 9 and repeats procedure until all the male quick connect fittings 9 are filled to their capacity.

Manual System

To install liquids into the engine 5, the operator installs the female quick connect fitting 21 to the male quick connect fitting 9, turns the body of the hand pump half a turn to install and manually pumps in the amount of liquid required for that engine cavity. The operator then moves the female quick connect fitting 21 to another male quick connect fitting 9 and repeats the procedure until all the male quick connect fittings 9 are filled to their capacity.

What is claimed is:

1. A two-part device for transferring liquid to or from an engine having engine water exhaust manifolds, the first part of said device comprising:

at least one engine connection means attachable to said engine water exhaust manifolds;

one line for each of said engine connection means, said line being anchored at one end to said engine connection means, and anchored at the other end to a vacuum pressure manifold, said vacuum pressure manifold housing a pump connection means for each line;

and the second part of said device comprising:

a pump;

two tanks connected to said pump, a first tank for holding the liquid drawn from the engine, and a second tank for holding the liquid to be transferred to the engine;

two lines connected to said tanks, wherein a first vacuum line is connected to said pump for drawing liquid from the engine to the tank, and a first pressure line is connected to said pump for pushing liquid from the tank into the engine;

connection means complementary to said pump connection means; and actuation means connected to a second vacuum line and a second pressure line, said actuation means controlling the function of said second vacuum line and said second pressure line, wherein when the second vacuum line is activated, fluid is drawn from the engine into the tank, and when the second pressure line is activated, fluid is pushed from the tank into the engine.

2. The device as claimed in claim 1, wherein said pump is an electric vacuum-pressure pump.

3. The device as claimed in claim 1, wherein said actuation means is a control valve.

* * * * *